US009343804B2

(12) United States Patent
Oh et al.

(10) Patent No.: US 9,343,804 B2
(45) Date of Patent: May 17, 2016

(54) ANTENNA APPARATUS FOR PORTABLE TERMINAL

(71) Applicant: Samsung Electronics Co., Ltd., Gyeonggi-do (KR)

(72) Inventors: Jun-Hwa Oh, Seoul (KR); Joon-Ho Byun, Gyeonggi-do (KR); Jae-Hee Kim, Gyeonggi-do (KR); Bum-Jin Cho, Gyeonggi-do (KR); Sang-Jin Eom, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 251 days.

(21) Appl. No.: 13/790,695

(22) Filed: Mar. 8, 2013

(65) Prior Publication Data

US 2013/0234910 A1 Sep. 12, 2013

(30) Foreign Application Priority Data

Mar. 12, 2012 (KR) ..... 10-2012-0025126

(51) Int. Cl.

| | |
|---|---|
| ***H01Q 1/24*** | (2006.01) |
| ***H01Q 1/42*** | (2006.01) |
| ***H01Q 1/44*** | (2006.01) |
| ***H01Q 5/378*** | (2015.01) |

(52) U.S. Cl.

CPC ..... *H01Q 1/42* (2013.01); *H01Q 1/243* (2013.01); *H01Q 1/44* (2013.01); *H01Q 5/378* (2015.01)

(58) Field of Classification Search

CPC ..... H01Q 1/243; H01Q 1/42; H01Q 5/0062; H01Q 1/44

USPC ..... 343/702, 872, 909

See application file for complete search history.

(56) References Cited

U.S. PATENT DOCUMENTS

| | | | | |
|---|---|---|---|---|
| 6,396,444 | B1 * | 5/2002 | Goward et al. | 343/702 |
| 7,847,753 | B2 * | 12/2010 | Ishibashi et al. | 343/897 |
| 8,432,321 | B2 * | 4/2013 | Arkko et al. | 343/702 |
| 2003/0045324 | A1 | 3/2003 | Nagumo et al. | |
| 2004/0200821 | A1 | 10/2004 | Voeltzel | |
| 2007/0008227 | A1 | 1/2007 | Napoles et al. | |
| 2008/0238801 | A1 | 10/2008 | Ragan | |
| 2009/0069061 | A1 * | 3/2009 | Laurent et al. | 455/575.7 |
| 2009/0153410 | A1 * | 6/2009 | Chiang et al. | 343/702 |
| 2009/0153412 | A1 * | 6/2009 | Chiang et al. | 343/702 |
| 2010/0271285 | A1 | 10/2010 | Yun et al. | |

(Continued)

FOREIGN PATENT DOCUMENTS

| | | | |
|---|---|---|---|
| JP | 11-307989 | A | 11/1999 |
| KR | 10-2004-0007081 | A | 1/2004 |
| KR | 10-2004-0047965 | A | 6/2004 |
| KR | 10-2006-0002951 | A | 1/2006 |

(Continued)

*Primary Examiner* — Hoanganh Le

(74) *Attorney, Agent, or Firm* — Cha & Reiter, LLC

(57) ABSTRACT

An antenna apparatus for a portable terminal is provided. The portable terminal includes a printed circuit board (PCB) having a ground surface and RF components to process a wireless signal received through at least one antenna element. A housing forms an external appearance of the portable terminal, and has a non-conductive member with a plurality of metal fragments attached thereto. At least one of the metal fragments is electrically connected to the ground surface. The metal fragments may enhance the texture and durability of the housing. Preferably, the shapes, sizes and distances separating the metal fragments are designed to minimally impact, or improve, the antenna performance provided by the at least one antenna element.

18 Claims, 18 Drawing Sheets

(56) References Cited

U.S. PATENT DOCUMENTS

| | | | | |
|---|---|---|---|---|
| 2010/0321253 | A1* | 12/2010 | Ayala Vazquez et al. | 343/702 |
| 2011/0050509 | A1* | 3/2011 | Ayala Vazquez | H01Q 1/2266 343/702 |
| 2011/0210903 | A1 | 9/2011 | Sarabandi et al. | |
| 2012/0176278 | A1* | 7/2012 | Merz et al. | 343/702 |
| 2012/0262345 | A1* | 10/2012 | Kim et al. | 343/702 |

FOREIGN PATENT DOCUMENTS

| | | | |
|---|---|---|---|
| KR | 10-2009-0060802 | A | 6/2009 |
| KR | 10-2009-0126294 | A | 12/2009 |
| KR | 10-2011-0037262 | A | 4/2011 |
| KR | 10-2011-0059675 | A | 6/2011 |
| WO | 2007/039071 | A2 | 4/2007 |
| WO | 2011/149489 | A1 | 12/2011 |

* cited by examiner

ANTENNA APPARATUS FOR PORTABLE TERMINAL

CLAIM OF PRIORITY

This application claims priority under 35 U.S.C. §119(a) to a Korean Patent Application filed in the Korean Intellectual Property Office on Mar. 12, 2012 and assigned Serial No. 10-2012-0025126, the contents of which are herein incorporated by reference.

BACKGROUND

1. Technical Field

This disclosure relates to an antenna apparatus for a portable terminal.

2. Description of the Related Art

At present, owing to the growth of the electronic communication industry, portable terminals such as mobile communication terminals (e.g., smart phones and cell phones), electronic schedulers, personal complex terminals and the like are becoming a necessity to modern society and an important means of delivery of rapidly changing information.

In recent years, the portable terminals are mesmerizing users by providing various multimedia functions and growing miniaturized for ease of portability. However, there is a difficulty in constructing various elements in a limited space of the portable terminal. Generally, the portable terminal includes an antenna for wireless communication. Recently, portable terminals have been developed with convenient built-in antennas which help to miniaturize the portable terminal. It is desirable that the built-in antenna meets predetermined performance metrics at a corresponding communication service band. But, in recent years, the portable terminal is increasingly making use of a metal member for enhancing aesthetics and reinforcing hardness. The metal member, however, is a cause of deteriorating the performance of the built-in antenna. Thus a need exists for ameliorating this problem.

SUMMARY

An aspect of the present invention is to substantially solve at least the above problems and/or disadvantages and to provide at least the advantages below. Accordingly, one aspect of the present invention is to provide an antenna apparatus achieving a desired antenna performance while occupying a smaller space within a portable terminal.

Another aspect of the present invention is to provide a portable terminal with a metal member for reinforcing hardness without adversely impacting a requisite antenna performance of the portable terminal.

In an exemplary embodiment, a portable terminal having an antenna apparatus includes a printed circuit board (PCB) having a ground surface and RF components to process a wireless signal received through at least one antenna element of the portable terminal. A housing forms an external appearance of the portable terminal, and has a non-conductive member with a plurality of metal fragments attached thereto. At least one of the metal fragments is electrically connected to the ground surface.

The metal fragments may enhance the texture and durability of the housing. Preferably, the shapes, sizes and distances separating the metal fragments are designed to minimally impact, or improve, the antenna performance provided by the at least one antenna element.

In another exemplary embodiment, an antenna apparatus for a portable terminal includes a printed circuit board (PCB) having a ground surface and RF components to process a wireless signal through at least one antenna element. A metal housing forms an external appearance of the portable terminal, and is electrically connected with the ground surface. The metal housing contains one or more slots in proximity to the antenna element.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF EXEMPLARY EMBODIMENTS

Exemplary embodiments of the present invention will be described herein below with reference to the accompanying drawings. In the following description, well-known functions or constructions are not described in detail since they would obscure the invention in unnecessary detail. And, terms described below, which are defined considering functions in the present invention, can be differ in meaning depending on user and operator's intent or practice. Therefore, the terms should be defined on the basis of the disclosure throughout this specification.

Exemplary embodiments of the invention provide an antenna apparatus using an arrangement of metal fragments on a housing which are provided in the portable terminal for reinforcement purpose. The fragments, also referred to as "islands," are preferably in the form of patches such as tiles, and may further serve as decoration elements. The antenna apparatus includes one or more antenna elements performing an antenna function at one or more respective frequency bands and/or protocols. The fragments are designed and arranged such that antenna performance otherwise obtained by the antenna element(s) without the islands is either insignificantly affected, unperturbed, slightly shifted, or improved.

According to an exemplary embodiment of the present invention, the portable terminal includes a housing having a non-conductive member (e.g., a molding), and a plurality of metal fragments attached to the non-conductive member to increase its hardness, add texture, and enhance aesthetics. Desirable antenna performance is maintained through proper configuration design of the shapes of the metal fragments, an arrangement form of the metal fragments, electrical connection between the metal fragments, and electrical connection between the metal fragments and the ground of a main board and the like. Further, according to an exemplary embodiment, the portable terminal incorporates a metal frame to increase durability and hardness and add to the aesthetics. The metal frame can be comprised of two or more isolated sections of which at least one is electrically connected to the ground of the main board, such that a desired antenna performance is maintained.

Figure 1:
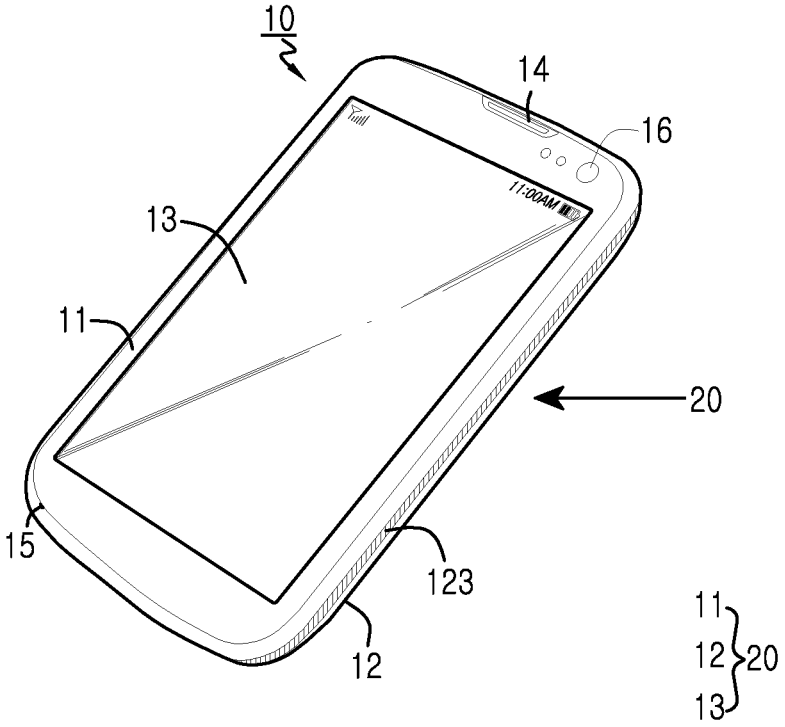
FIG. 1 is a perspective view illustrating a portable terminal according to an exemplary embodiment of the present invention.

FIG. 1 is a perspective diagram illustrating a portable terminal 10 according to an exemplary embodiment of the present invention. Portable terminal 10 preferably includes a housing 20 forming its external appearance, a display 13 outputting images and video, a speaker 14 outputting sound, a microphone 15 receiving sound input, and a camera 16. The display 13 may be a touch screen. Physical keys may be included as well to provide additional input means.

The housing 20 includes a front housing 11, a rear housing 12, and a metal frame 123. The front housing 11, the rear housing 12, and the metal frame 123 are coupled to one another and form an external appearance of the portable terminal 10. The housing includes a plurality of metal fragments attached to a non-conductive molding (described below), thus adding texture and durability to the portable terminal 10. The metal frame 123 can be comprised of two or more isolated sections.

As detailed below, the portable terminal 10 includes an antenna apparatus for wireless communication. The antenna apparatus includes at least one antenna element receiving and supplying RF signal power from and to RF circuit components of a printed circuit board (PCB), e.g., a main board, and resonating. A point on the antenna element may be connected to the ground of the PCB in an Inverted F Antenna (IFA) or a Planar Inverted F antenna (PIFA) configuration. The antenna element can alternatively be a monopole antenna. The antenna element is preferably of a form in which it is constructed within the portable terminal 10. However, it is possible to include one or more antenna elements that protrude to the exterior of the portable terminal 10.

The antenna apparatus achieves desirable antenna performance through proper design of the shapes of the metal fragments of the housing, the arrangement form of the metal fragments, the electrical connection between the metal fragments, the electrical connection between the metal fragments and the ground of the main board and the like. In other words, the metal fragments constructed in the housing do not deteriorate the performance of the antenna element (or only minimally affect performance or shift a resonant frequency) and may improve certain characteristics.

Figure 2:
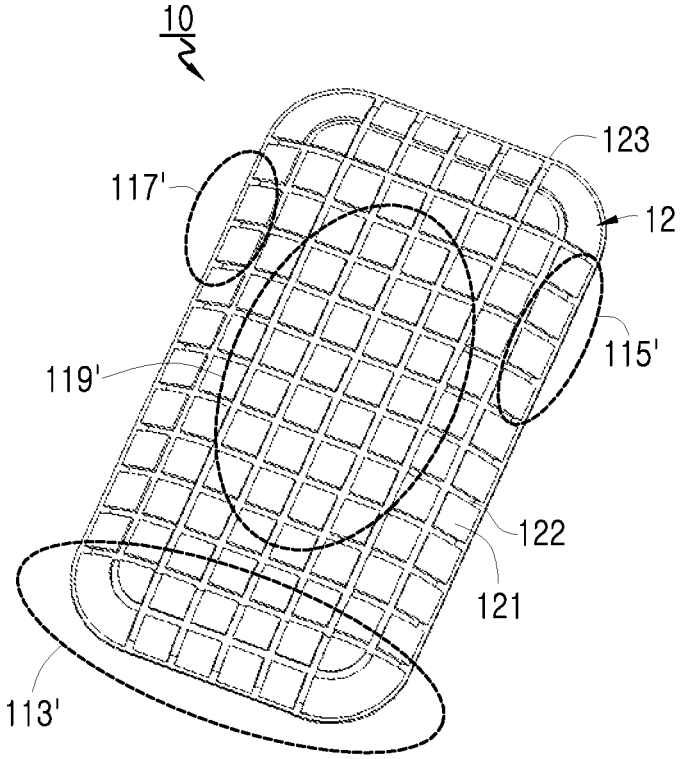
FIG. 2 is a perspective view illustrating an example configuration of a rear housing of the portable terminal of FIG. 1.

FIG. 2 is a perspective diagram illustrating an example configuration of the rear housing 12 of the portable terminal 10. Rear housing 12 includes a plastic member 122, and a plurality of metal fragments 121 placed or formed on the plastic member 122. Member 122 is preferably made by a molding process, and will thus hereafter be referred to as plastic molding 122. The plastic molding 122 supports the metal frame 123, which is fixed to the plastic molding 122. The regions 113', 115', 117' and 119' denote regions where corresponding antenna elements 113, 115, 117 and 119 (described in subsequent figures) may be located beneath, within the portable terminal 10.

Figure 3:
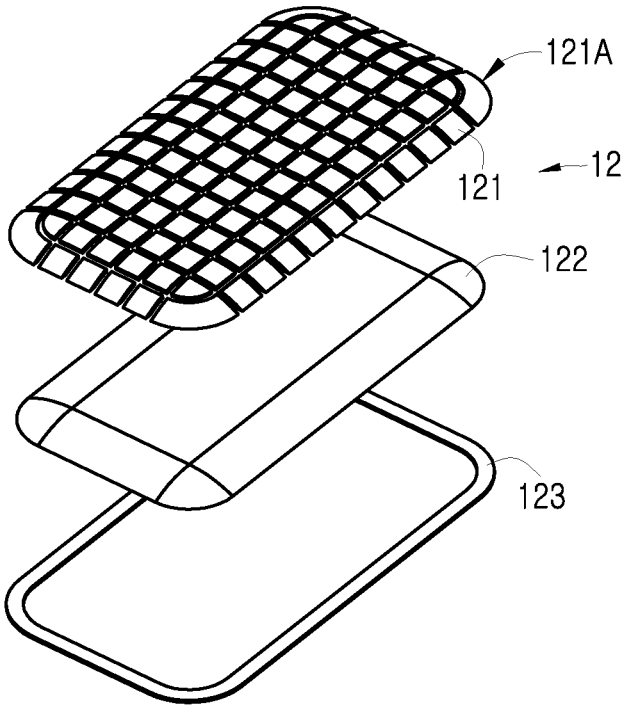
FIG. 3 illustrates construction of an example housing portion of a portable terminal according to an exemplary embodiment of the present invention.

FIG. 3 illustrates a configuration of the example rear housing 12 in relation to the metal frame 123. The rear housing 12 is comprised of an arrangement 121A of metal fragments 121 placed or formed on a major surface of plastic molding 122. The metal fragments 121 on the housing 12 are in an island shape, i.e., completely separated from adjacent fragments 121 with the exception of small electrical connections between some of the fragments 121. The island shapes with the separations between fragments add texture and durability to the rear housing 12. With proper setting of the size of the fragments and spacing therebetween, desirable antenna performance of the antenna elements of portable terminal 10 over requisite operating frequency bands is maintained. For example, Electromagnetic waves from the antenna elements may radiate to the exterior through spaces between the metal islands, and electromagnetic waves from the exterior may introduce into the antenna elements through the spaces. Also, the metal islands may shield noises generated from a plurality of electronic components including the PCB, and may shield noises from the external. Therefore, performance of the antenna elements is secured. Also, In accordance with another exemplary embodiment of the present invention, the housing 12 may not construct the metal fragments in places adjacent to the at least one or more antenna elements, for avoiding interference from the metal fragments, to secure the antenna performance (not illustrated). The metal fragments 121 constructed in the island shape on the housing 12 are called metal islands. The metal islands can be formed on housing 12 by attaching the metal fragments 121 to the plastic molding (or body) 122. For example, recesses may be formed within the molding 122 to facilitate attachment of the metal fragments 121 via suitable bonding or press fitting. Another method of forming the metal islands 121 is through a process of plating the plastic molding 122 with Electromagnetically Transparent Decorative Metal (ETDM) and etching the plated ETDM.

As shown in FIGS. 2 and 3, the metal fragments 121 can have a uniform shape and/or size; however, other embodiments with nonuniform shape/size are possible. Most of the metal fragments 121 are electrically isolated from each other. However, some of the fragments 121 may be electrically connected to enhance antenna performance at certain frequencies. For example, the electrical connection structure between some fragments 121 may play a role of adjusting a resonance frequency of the antenna elements. For example, the electrical connection structure may be configured to loop type, and may be resonate, like as a slot antenna, in-direct feed from the antenna. Therefore, the antenna elements may make a specific resonance frequency in company with the electrical connection structure. The electrical connection structure is arranged to overlap with at least one portion of the antenna elements. Wherein, the connection structure may have the same or different resonance length as those of the at least one or more antenna element. The metal fragments 121 can each be designed with a surface area of about 1 $mm^2$ to 400 $mm^2$×a thickness of about 0.1 mm to 5 mm, and can be arranged at a spaced distance of about 0.1 mm to 5 mm.

The portable terminal 10 can be embodied with a plurality of antenna elements, each for a respective operating frequency band/protocol. For example, as seen in FIG. 4, portable terminal 10 can include an antenna element 113 for cellular communication, an antenna element 115 for Global Positioning System (GPS), an antenna element 117 for Bluetooth or Wireless Fidelity (WiFi), and an antenna element 119 for Near Field Communication (NFC).

Figure 4:
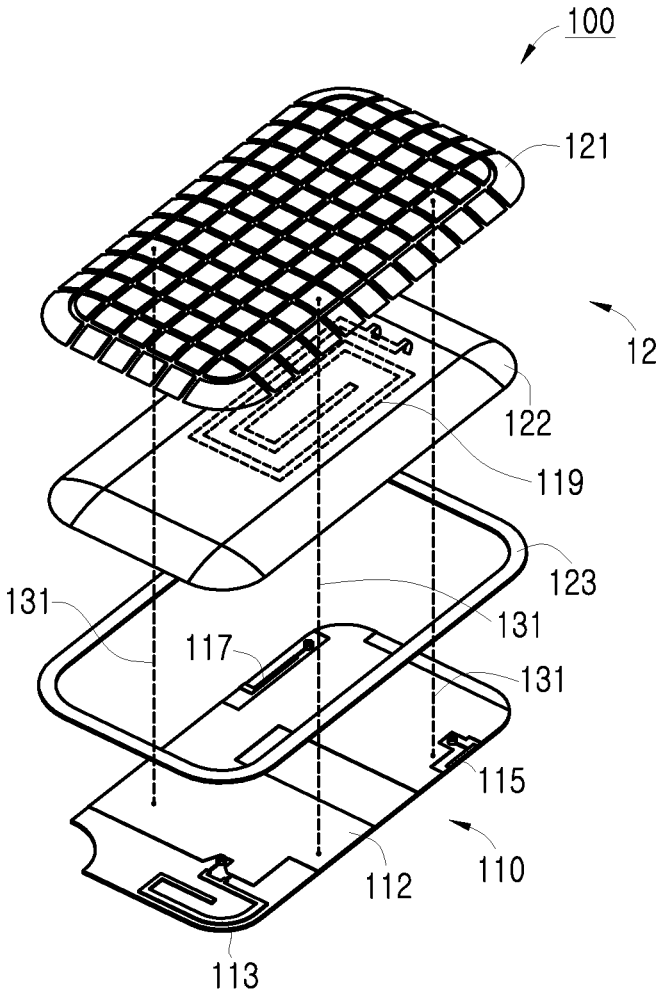
FIG. 4 is exploded views depicting a construction of an antenna apparatus according to an exemplary embodiment of the present invention.
Figure 5:
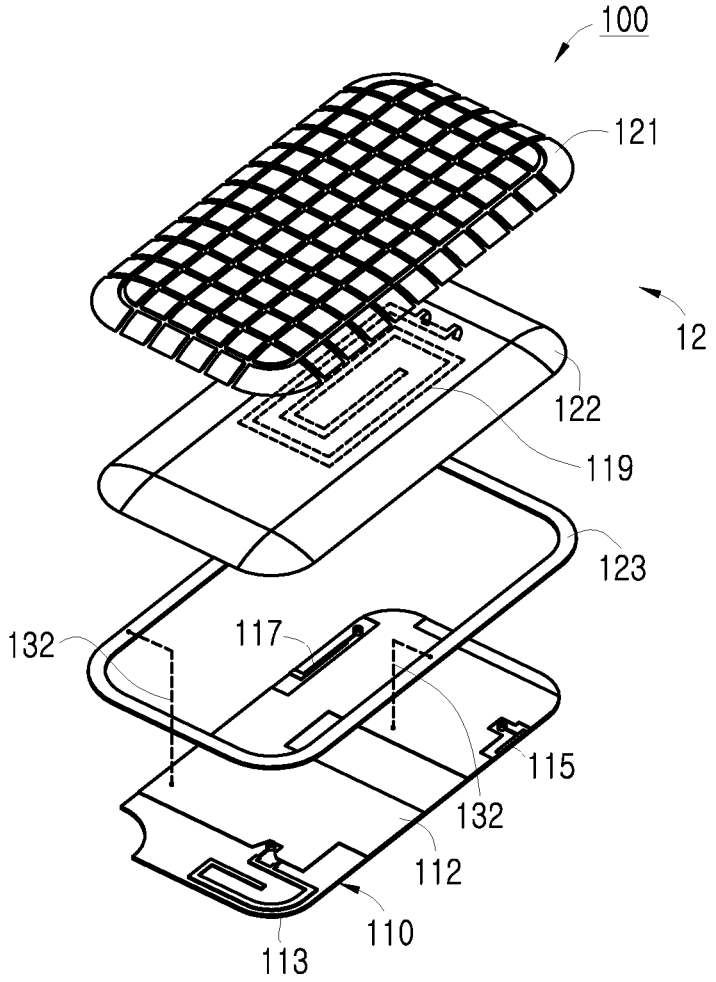
FIG. 5 is exploded views depicting a construction of an antenna apparatus according to an exemplary embodiment of the present invention.

FIGS. 4 and 5 are exploded views depicting a construction of an antenna apparatus 100 according to an exemplary embodiment of the present invention, which may be used within the portable terminal 10. (Note that FIGS. 4 and 5 show the same general antenna apparatus 100; however, FIG. 4 illustrates electrical connections between the metal fragments 121 and a ground surface 112, while FIG. 5 illustrates electrical connections between the metal frame 123 and the ground surface 112. Both types of electrical connections can be incorporated in an embodiment.)

Referring to FIGS. 4 and 5, the antenna apparatus 100 includes the PCB 110, the antenna elements 113, 115, 117, and 119 which are RF coupled to communication circuits on PCB 110, and the rear housing 12 forming the external rear appearance of the portable terminal 10.

The PCB 110, which is a substrate containing basic circuits and parts, includes RF communication, processing and control parts to carry out the functions of portable terminal 10. These include configuring an execution environment of the portable terminal 10, keeping information thereof, allowing the stable driving of the portable terminal 10, and input/output data exchange of all devices of the portable terminal 10. The PCB 110 circuit components process wireless signals transmitted/received through the antenna elements 113, 115, 117, and 119. PCB 110 commonly includes a ground surface 112, i.e., a surface of reference potential. The ground 112 is electrically connected to at least one of the metal fragments 121 of the housing 12 through electrical connection means 131, shown schematically. Any suitable connection means 131 can be employed. For instance, the molding 122 can contain apertures (not shown) through which flexible electrical posts pass, each electrical post is affixed on one end to an individual island 121 and on the other end makes a pressure contact connection with a socket on the ground 112. The one or more metal fragments 121 electrically connected with the ground 112 are applied as additional ground bodies of the portable terminal 10, to favorably influence antenna performance of the antenna apparatus 100 as desired. The isolation structure of the metal fragments 121 may result in not interfacing a resonance frequency of antenna elements. For example, the isolation structure of the metal fragments 121 may allow electromagnetic waves to be smoothly transmitted from the antenna element to the exterior, and allow electromagnetic waves to be smoothly introduced into the antenna element. Additionally, The electrical connection structure between some fragments 121 may be used for adjusting a resonance frequency of antenna in certain frequencies.

Also, the housing 12 is embodied with the metal frame 123. The metal frame 123 is electrically connected to the ground 112 through a suitable electrical connection means 132 (shown schematically) and is adapted to favorably influence the antenna performance of the antenna apparatus 100. Further, the metal frame 123 can be electrically connected with one or more metal fragments 121 of the housing 12.

Figure 4A:
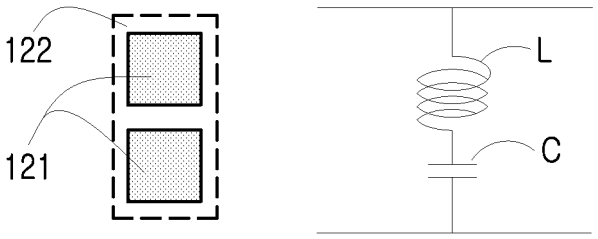
FIG. 4A shows an equivalent circuit for adjacent metal islands of a housing.

As mentioned earlier, the metal fragments 121 of the housing 12 are isolated from one another, preventing degradation of antenna performance of antenna elements 113, 115, 117, and 119. For example, the isolation structure of the metal fragments 121 may allow electromagnetic waves to be smoothly transmitted from the antenna element to the exterior, and allow electromagnetic waves to be smoothly introduced into the antenna element. Furthermore, as shown in FIG. 4A, due to the isolation structure of the metal fragments 121, they generate a reactance across the fragments as shown in the equivalent circuit of an inductance L in series with a capacitance C. This reactance helps to maintain the antenna performance of antenna elements 113, 115, 117, and 119. That is, the design of antenna elements 113, 115, 117 and 119 can be modified (made smaller in some cases) in consideration of the presence of the reactance of the metal fragments 121.

The isolation structure of the metal fragments 121 may further operate as a band cutoff filter cutting off electromagnetic waves of higher frequency bands incident from the exterior than those normally received by antenna elements 113-119. For example, the metal fragments 121 as the a band cutoff filter are designed with size, shape, and spaced distance to have a different resonance frequency than those of the antenna elements 113, 115, 117, and 119, such that no adverse effects on the operations of the antenna elements 113-119 are produced. For example, the antenna element 113 can have a resonance frequency of about 900 Mega Hertz (MHz) or 1800 MHz, whereas the isolation structure of the metal fragments 121 can result in a resonance frequency of about 40 Giga Hertz (GHz) to 100 GHz. In this design, the length of each individual metal island 121 is substantially less than those of the antenna elements 113-119.

Moreover, in some embodiments, the isolation structure of the metal fragments 121 can play a role of adjusting a resonance frequency of the antenna apparatus 100. That is, the reactance presented by the metal fragments 121 as depicted in FIG. 4A can result in a shift in the resonance frequencies that the antenna elements 113-119 exhibit without the presence of the metal fragments 121. Accordingly, embodiments of the present invention can adjust a desired resonance frequency considering the isolation structure of the metal fragments 121. Due to an intentionally designed resonance shifting effect, the antenna elements 113, 115, 117, and 119 can be constructed in a smaller size than otherwise, whereby the construction space of the antenna elements 113, 115, 117, and 119 can be reduced.

Further, one or more metal fragments 121 are electrically connected with the ground 112 of the PCB 110. The isolation structure of the metal fragments 121 applies the aforementioned equivalent circuit and therefore, static electricity can be prevented owing to such grounding.

Figure 6:
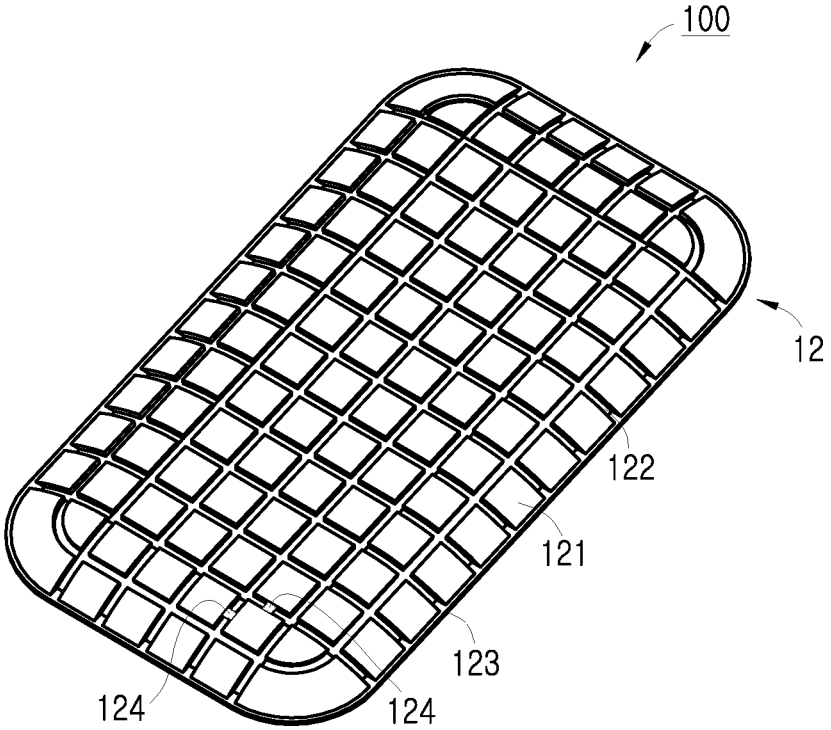
FIG. 6 illustrates exemplary electrical connections between metal fragments of a housing in an antenna apparatus according to an exemplary embodiment of the invention.
Figure 6:
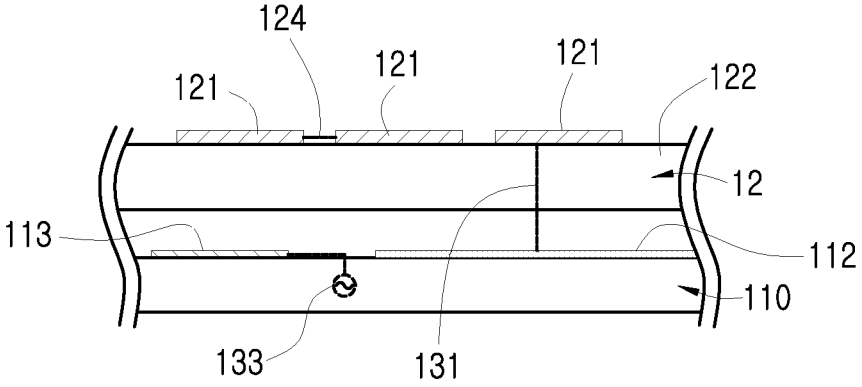

FIG. 6 illustrates exemplary electrical connections between metal fragments of a housing 100 according to an exemplary embodiment. In the shown example, the antenna apparatus 100 has a construction of connecting, through electrical connection means 124, the metal fragments 121 of the housing 12 located around the antenna elements 113, 115, 117, and 119. Because the isolation structure of the metal fragments 121 has a limit in improving the antenna performance of the antenna elements 113, 115, 117, and 119, the aforementioned construction helps to overcome this limit. A cross-sectional view across several metal fragments 121 is also depicted. (Note that antenna element 113 is seen connecting to an RF signal source 133 on PCB 110; the other antenna elements 115, 117 and 119 may likewise connect to respective signal sources.) The at least one metal fragments 121 electrically connected to at least one antenna element is arranged or not to overlap with one of the antenna elements 112,113, 115, 117 and 119.

Figure 7:
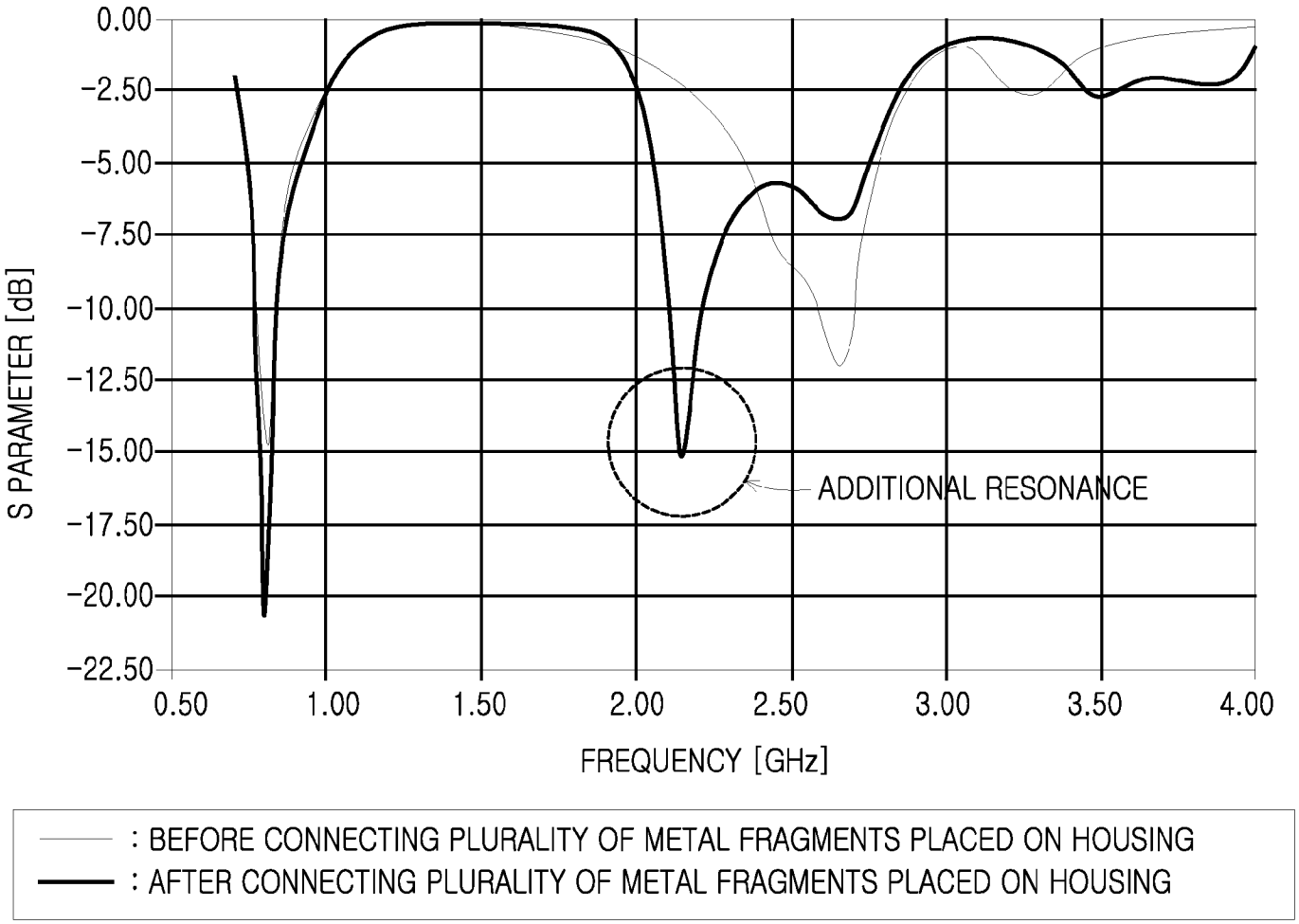
FIG. 7 is a graph illustrating a characteristic of an antenna apparatus according to an exemplary embodiment of the present invention.

FIG. 7 is a graph illustrating a characteristic of an antenna apparatus according to an exemplary embodiment of the present invention. The graph represents measured results for an antenna apparatus in the form of antenna apparatus 100 of FIG. 6, as compared to a conventional apparatus that utilizes only a plastic molding without metal fragments in the rear housing. The results show that an additional resonance frequency is generated when the metal islands are included, thus providing a broader resonance band. Resonance frequencies between 0.5-1.0 GHz and 2.5-3.0 GHz are shown to be maintained (with improved tuning at the lower band and some detuning at the higher band.)

Figure 8:
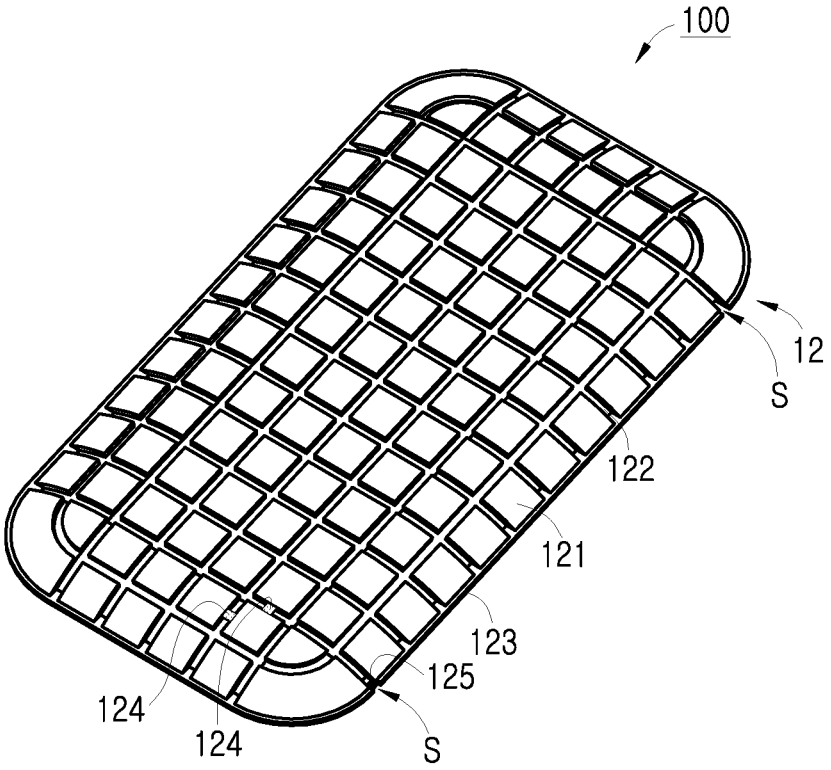
FIG. 8 is a diagram depicting a construction of an antenna apparatus according to an exemplary embodiment of the present invention.

FIG. 8 depicts a construction of an antenna apparatus according to an exemplary embodiment of the present invention. In this embodiment, the metal frame 123 of the housing 12 separated into two or more sections, and at least one of the sections is electrically connected with the ground of the PCB 110. In the example depicted, separate sections separated by the spaces S are formed. The sections of the metal frame 123 are connected to one another by electrical connection means 125. With this configuration, suitable antenna performance, and in some cases, superior antenna performance has been attained.

Figure 9:
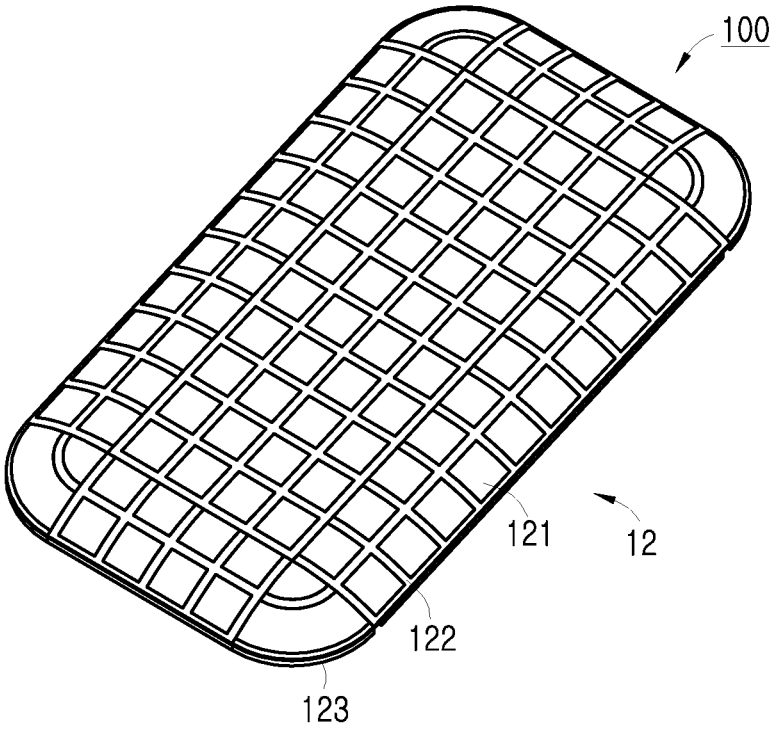
FIG. 9 is a diagram depicting a construction of a housing according to an exemplary embodiment of the present invention.
Figure 9:
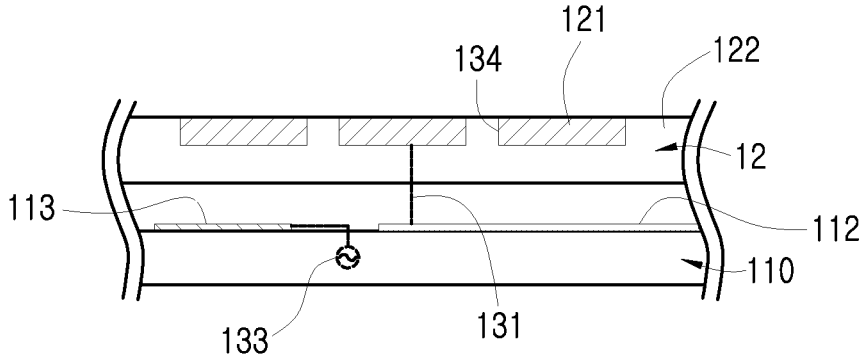

FIG. 9 depicts a construction of a housing according to another exemplary embodiment of the present invention. In this embodiment, the plastic molding 122 of the housing 12 is constructed with a plurality of recesses 134. The metal fragments 121 are placed in the recesses 134. In this example, the metal fragments 121 are of the same thickness as the recesses, hence their outer surfaces are flush with the outer surface of the plastic molding 122 after being placed or formed within the recesses, as seen in the cross sectional view at the bottom of the figure. In other embodiments, the thickness of the fragments may differ from that of the recesses.

Figure 10A:
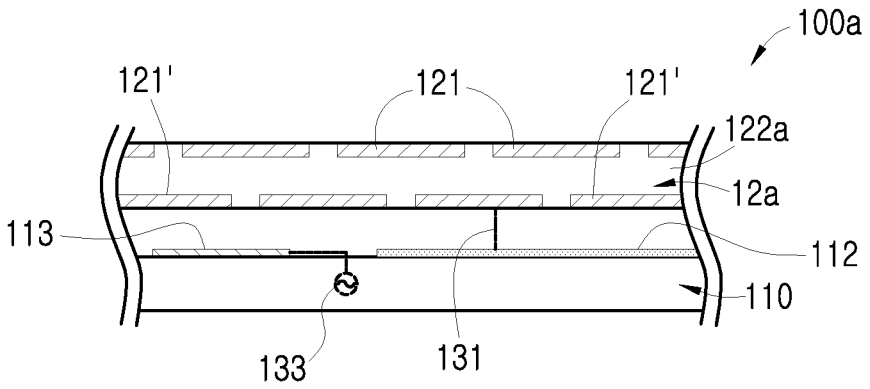
FIGS. 10A, 10B and 10C depict constructions of housings according to further respective exemplary embodiments of the present invention.
Figure 10B:
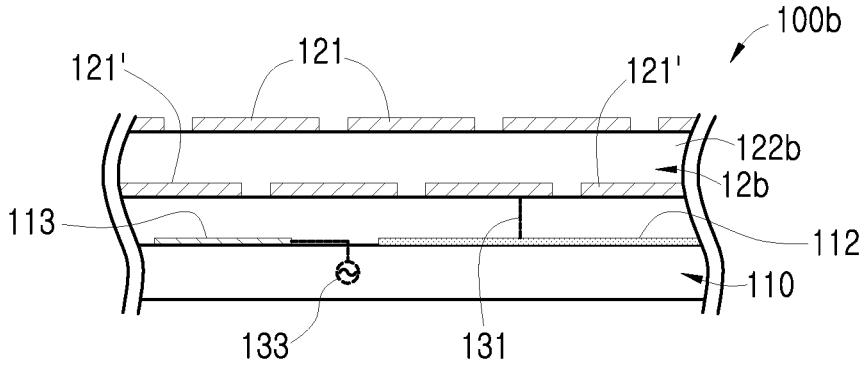
Figure 10C:
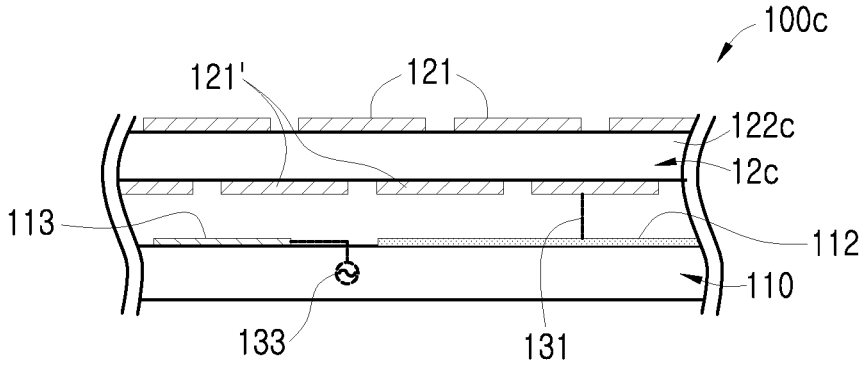

FIGS. 10A to 10C depict respective constructions of housings according to further exemplary embodiments of the present invention in cross sectional views.

Referring to FIG. 10A, an antenna apparatus 100*a* is embodied with a rear housing 12*a* formed with a plastic molding 122*a* that has a plurality of recesses in both its inner surface and outer surface. Outer metal fragments 121 are placed in the outer surface recesses, and inner metal fragments 121' are placed or formed in the inner surface recesses. At least one inner fragment 121' is grounded to ground surface 112. One or more outer fragments 121 may also be grounded. The outer fragments 121 are arranged in a grid-like fragment array as shown in FIGS. 2 to 6. Inner fragments 121' are arranged in a similar array; however, they are offset in a staggered relationship with respect to the upper fragment array as illustrated in FIG. 10A, providing a visual effect to the user when the plastic molding 122*a* is made of transparent material. The inner metal fragments can be designed in size, shape and with spacing to favorably influence antenna performance of antenna elements 113-119, and to bolster rigidity of the housing 122*a*.

Referring to FIG. 10B, an embodiment of an antenna apparatus 100*b* includes a rear housing 12*b* embodied with plastic molding 122*b*. Plastic molding 122*b* of the housing 12 is constructed with a plurality of recesses in its inner surface. Outer metal fragments 121 are placed or formed on top of an outer surface of the plastic molding 122; inner metal fragments 121' are placed or formed in the recesses constructed in the inner surface. The purpose of the inner fragment array, and its staggered relationship with the outer fragment array, is the same as that described for antenna apparatus 100*a*.

Referring to FIG. 10C, an antenna apparatus 100*c* includes a rear housing 12*c* having a plastic molding 122*c* without recesses. Outer metal fragments 121 are placed or formed on the outer surface; inner metal fragments 121' are placed or formed on an inner surface of the plastic molding 122. The purpose of the inner fragment array, and its staggered relationship with the outer fragment array, is the same as that described for antenna apparatus 100*a*.

The plastic molding 122 of FIGS. 10A to 10C is formed of transparent material, so the inner metal fragments are seen through the plastic molding 122. The inner metal fragments, in addition to influencing antenna performance and increasing rigidity and durability, present a visual effect together with the outer metal fragments.

Figure 11:
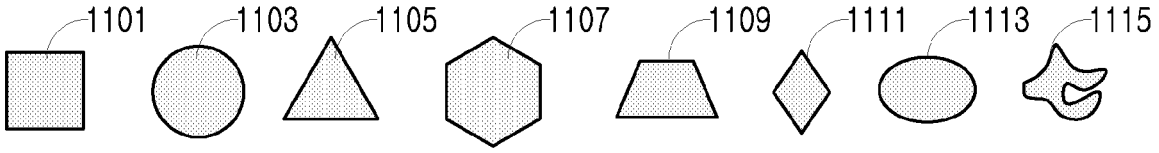
FIG. 11 depicts various shapes of metal fragments of a housing that may be used in exemplary embodiments of the present invention.

FIG. 11 depicts various shapes of metal fragments of a housing that may be used in exemplary embodiments of the present invention. The metal fragments 121 placed on the housing can have various shapes such as a rectangle or square 1101, a circle 1103, a triangle 1105, a hexagon 1107, a rhombus 1109, a diamond 1111, an oval 1113 or a random shape 1115, as illustrated.

Figure 12:
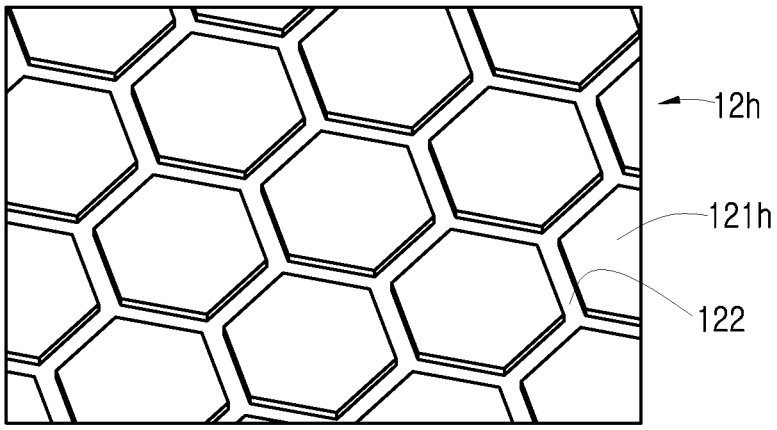
FIG. 12 illustrates a section of a housing with uniformly metal fragments and spacings according to an exemplary embodiment of the present invention.

FIG. 12 depicts a section of a housing 12*h* according to an exemplary embodiment of the present invention. Housing 12*h* includes a plurality of metal fragments 121*h* in the shape of a hexagon or other uniform shape, placed or formed on the plastic molding 122. The shapes of the metal fragments 121*h* are uniform, and the distances between the metal fragments 121*h* are the same (a uniform spacing is used between all adjacent fragments 121*h*).

Figure 13:
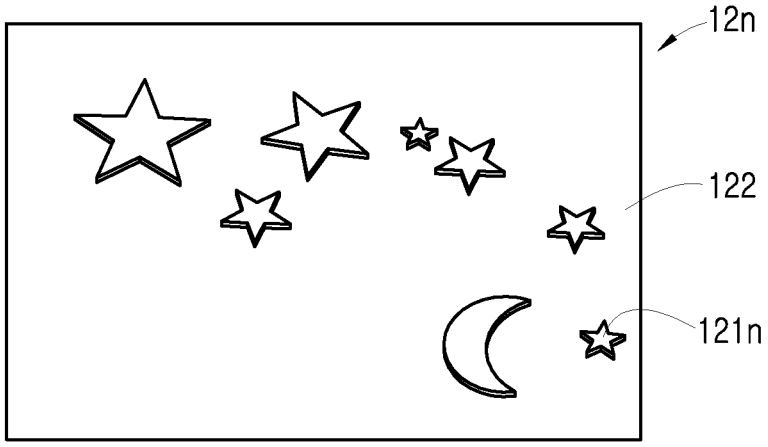
FIG. 13 illustrates a section of a housing with non-uniform metal fragments and/or spacings according to another exemplary embodiment.

FIG. 13 illustrates a section of a housing 12*n* with non-uniform metal fragments and/or spacings according to another exemplary embodiment. Housing 12*n* includes a plurality of metal fragments 121*n* placed or formed on the plastic molding 122. The metal fragments 121*n* are of different shapes and/or sizes. Further, the metal fragments 121*n* may be spaced from one another non-uniformly.

Figure 14:
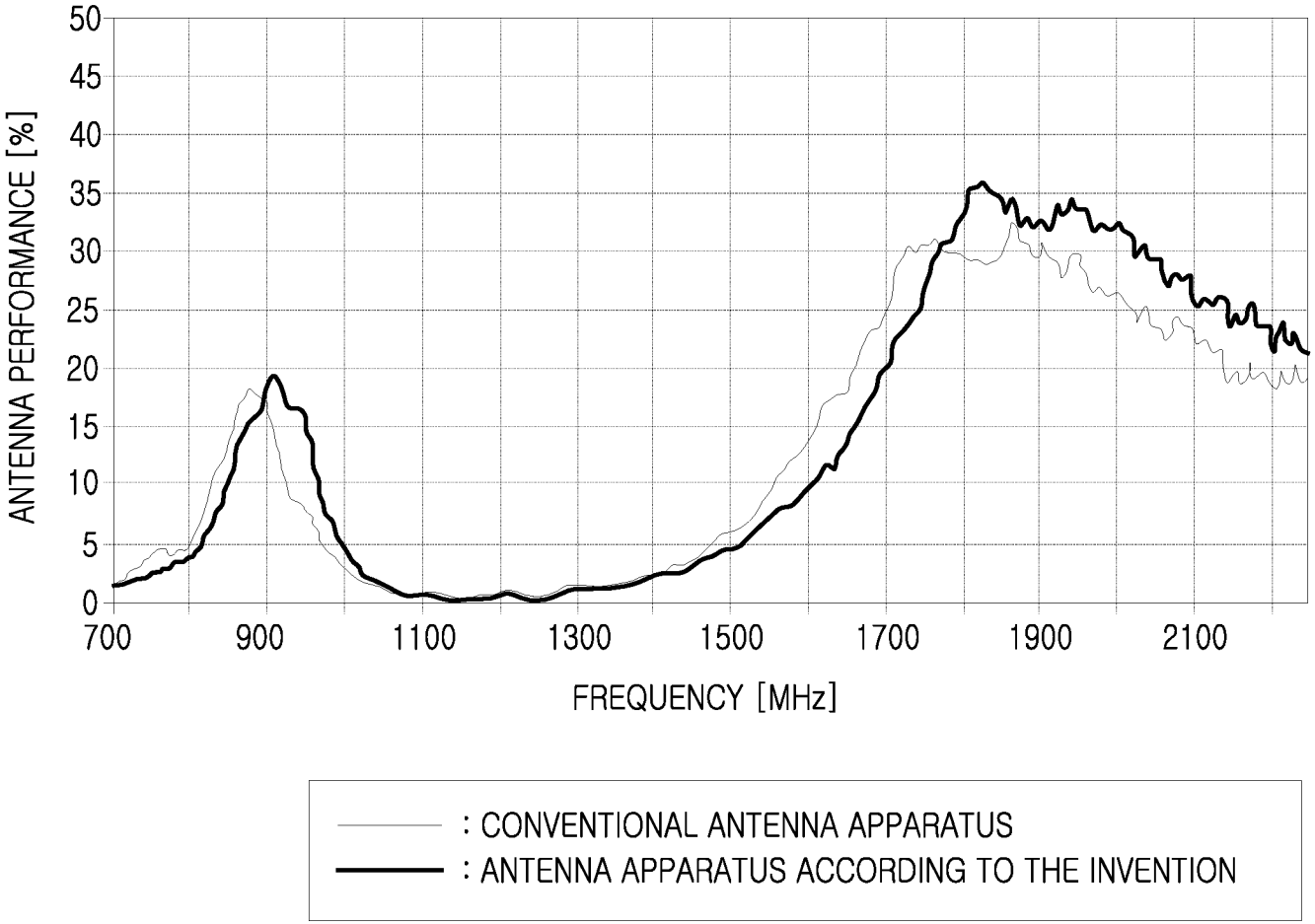
FIG. 14 is a graph illustrating the antenna performance of an antenna apparatus according to an exemplary embodiment of the present invention.

FIG. 14 is a graph illustrating antenna performance of an antenna apparatus 100 according to an exemplary embodiment of the present invention, as compared to a conventional apparatus. The antenna apparatus 100 within a portable terminal of the present invention utilizes a housing that is comprised of a plastic molding to which metal fragments are attached. The conventional portable terminal applies a housing that is comprised of only a plastic molding. The results of antenna efficiency vs. frequency illustrate that antenna performance is slightly shifted as a function of frequency. That is, antenna performance is not degraded in the environment using the metal fragments, despite the fact that the presence of parasitic metal typically degrades antenna performance. Thus the housing with metal fragments in accordance with the invention can be used to provide a minor frequency shifting effect as desired, with the advantage of a rear housing having enhanced texture, durability and aesthetics.

Figure 15:
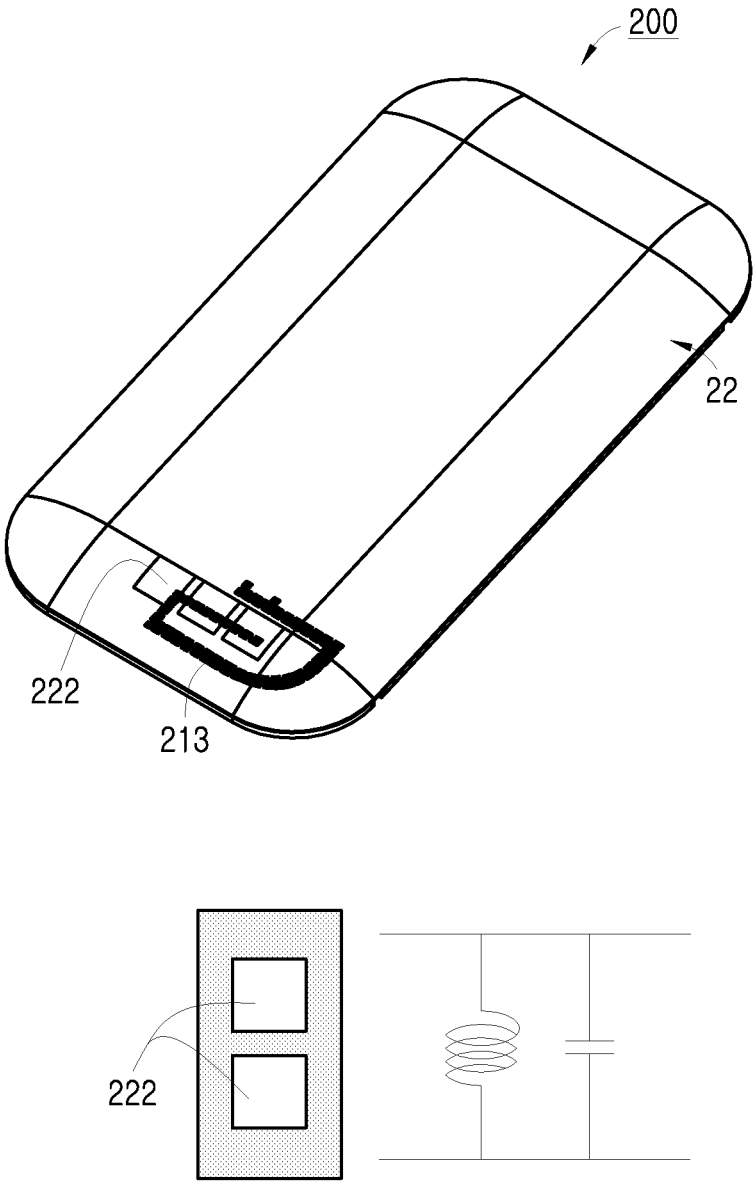
FIGS. 15 and 16 are views antenna apparatus of portable terminals according to respective alternative exemplary embodiments of the present invention.

FIG. 15 is a perspective view of an antenna apparatus 200 of a portable terminal according to an alternative exemplary embodiment of the present invention. The antenna apparatus 200 includes a built-in antenna element 213 coupled to an RF communication circuit of a PCB (not shown) and resonating, and a metal housing 22 electrically connected to the ground of the PCB and forming an external appearance of a portable terminal. Particularly, the metal housing 22 has one or more slots 222 in the vicinity of the antenna element 213 formed by cutting away metal from the housing 22. The slots 222 present a reactance to the antenna element 213 as depicted by the equivalent circuit of an inductance and capacitance in parallel. The equivalent reactance presented by the slots favorably affects antenna performance of the antenna element 213, such that desired metrics can be attained. The slots 222 of FIG. 15 have the same shape and size, and a distance between the slots 222 is uniform. The metal housing 22 further has a plastic molding on its inner surface, and the slots 222 are hidden by the plastic molding.

Figure 16:
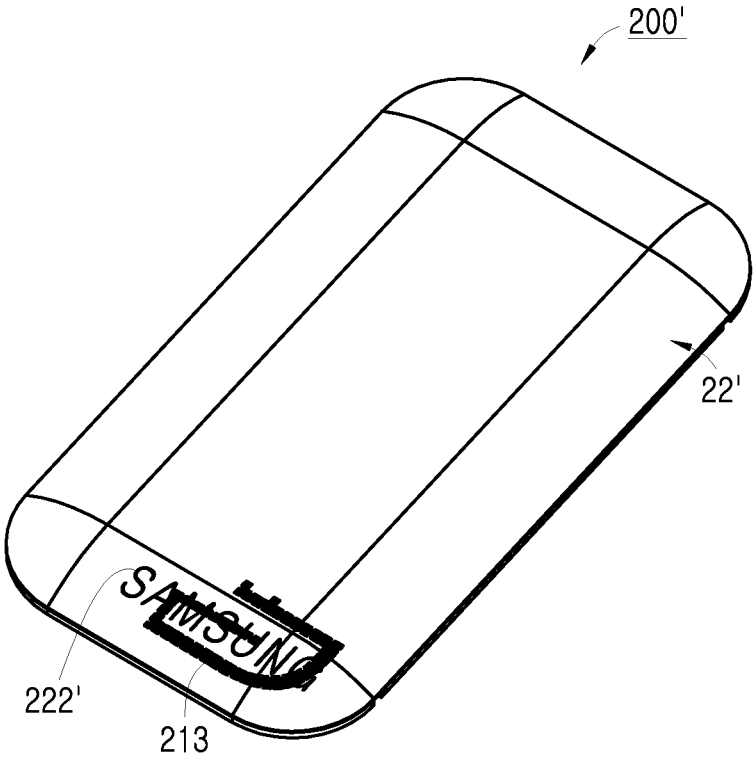

FIG. 16 is a perspective view of an antenna apparatus 200' of a portable terminal according to an alternative exemplary embodiment of the present invention. Antenna apparatus 200' is the same as antenna apparatus 200, except that non-uniform sized slots 222' are formed in the housing 22' surface in the vicinity of antenna element 213. The non-uniform slots 222' may also be spaced non-uniformly from one another. The non-uniform slots 222' are intended to favorably affect antenna performance of the antenna element 213 in a similar manner as in the embodiment of FIG. 15.

Accordingly, a portable terminal incorporating the antenna apparatus of FIG. 15 or 16 can exhibit improved antenna performance as compared to a conventional portable terminal with the entire rear housing formed of continuous metal.

In the hereto described embodiments of the present invention, the housing 12 or 22 can include a battery cover of the portable terminal. The battery cover can be also realized as an element of the antenna apparatus of the present invention.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A portable terminal comprising:

a printed circuit board (PCB) having a ground surface and RF components to process a wireless signal received through at least one antenna of the portable terminal; and a housing forming an external appearance of the portable terminal, having a non-conductive member with a plurality of metal fragments attached thereto, with at least some of the metal fragments being electrically isolated from one another and proximate the at least one antenna;

wherein the at least one antenna is disposed on the PCB and is separated from the housing; and wherein at least one of the metal fragments is electrically connected to the ground surface so as to prevent static electricity while the plurality of metal fragments provide a reactance that shifts a resonance frequency of the at least one antenna.

2. The portable terminal of claim 1, wherein a majority of the metal fragments are electrically connected to one another.

3. The portable terminal of claim 2, wherein the plurality of metal fragments electrically connected to one another have the same or different resonance length as those of the at least one antenna.

4. The portable terminal of claim 1, wherein the metal fragments are different from one another in shape or size.

5. The portable terminal of claim 1, wherein the housing comprises a battery cover of the portable terminal.

6. The portable terminal of claim 1, further comprising a metal frame comprised of a plurality of mutually isolated sections, wherein at least one of the sections is electrically connected with the ground surface of the PCB, or is electrically connected with one or more ground-connected metal fragments of the housing.

7. The portable terminal of claim 1, wherein the at least one antenna element is a monopole antenna, an Inverted F Antenna (IFA), or a Planar Inverted F Antenna (PIFA).

8. The portable terminal of claim 1, wherein the at least one antenna element is configured for communication in at least one of cellular communication, Global Positioning System (GPS), Wireless Fidelity (WiFi), Bluetooth, and Near Field Communication (NFC).

9. The portable terminal of claim 1, wherein the non-conductive member contains a plurality of recesses, and the metal fragments are placed or formed in the recesses.

10. The portable terminal of claim 1, wherein the non-conductive member is semitransparent or transparent.

11. The portable terminal of claim 1, wherein the metal fragments have a surface area of 1 $mm^2$ to 400 $mm^2$ ×a thickness of 0.1 mm to 5 mm, and are arranged at a spaced distance of 0.1 mm to 5 mm.

12. The portable terminal of claim 1, wherein the metal fragments are attached to an outer surface of the housing, the outer surface forms a rear surface of the portable terminal, and the metal fragments are arranged to cover a majority of the rear surface.

13. The portable terminal of claim 12, wherein the metal fragments are arranged to cover substantially an entirety of the rear surface.

14. An antenna apparatus for a portable terminal, the apparatus comprising:

a printed circuit board (PCB) having a ground surface and RF components to process a wireless signal through at least one antenna resonating element; and a metal housing forming an external appearance of the portable terminal, and electrically connected with the ground surface;

wherein the metal housing contains plural slots in proximity to the least one antenna resonating element, the slots respectively forming shapes of characters, and each overlaying a respective portion of the at least one antenna resonating element, wherein a portion of the metal housing in between first and second slots of the plural slots overlays another portion of the at least one antenna resonating element.

15. The apparatus of claim 14, wherein the characters are letters, and the apparatus further comprising a non-conductive molding attached to an inner surface of the metal housing, wherein the non-conductive molding abuts the one or more slots.

16. The apparatus of claim 14, wherein the slots present a reactance to the at least one antenna element.

17. The apparatus of claim 14, wherein each of the plural slots is filled by a non conductive material.

18. A portable terminal comprising:

a printed circuit board (PCB) having a ground surface and RF components to process a wireless signal received through at least one antenna of the portable terminal;

a housing forming an external appearance of the portable terminal, having a non-conductive member with a plurality of outer metal fragments disposed on an outer surface thereof so as to form a part of the external appearance of the portable terminal; and a plurality of inner metal fragments placed or formed on an inner surface of the non-conductive member;

wherein the at least one antenna is disposed on the PCB and is separated from the housing; and wherein at least one of the inner or outer metal fragments is electrically connected to the ground surface.

* * * * *